US011682365B2

(12) United States Patent
Amin et al.

(10) Patent No.: US 11,682,365 B2
(45) Date of Patent: Jun. 20, 2023

(54) METHODS FOR ACHIEVING, AND APPARATUS HAVING, REDUCED DISPLAY DEVICE ENERGY CONSUMPTION

(71) Applicant: Corning Incorporated, Corning, NY (US)

(72) Inventors: Jaymin Amin, Corning, NY (US); Shandon Dee Hart, Elmira, NY (US); Brooke Amber Hathaway, Boulder, CO (US); Karl William Koch, III, Elmira, NY (US); Carlo Anthony Kosik Williams, Painted Post, NY (US); Alexandre Michel Mayolet, Corning, NY (US)

(73) Assignee: Corning Incorporated, Corning, NY (US)

( * ) Notice: Subject to any disclaimer, the term of this patent is extended or adjusted under 35 U.S.C. 154(b) by 422 days.

(21) Appl. No.: 16/654,785

(22) Filed: Oct. 16, 2019

(65) Prior Publication Data

US 2020/0126512 A1 Apr. 23, 2020

Related U.S. Application Data

(60) Provisional application No. 62/746,811, filed on Oct. 17, 2018.

(51) Int. Cl.
*G09G 5/10* (2006.01)
*G09G 5/02* (2006.01)

(52) U.S. Cl.
CPC ..... *G09G 5/10* (2013.01); *G09G 5/02* (2013.01); *G09G 2320/0626* (2013.01); *G09G 2320/0666* (2013.01); *G09G 2330/023* (2013.01); *G09G 2354/00* (2013.01); *G09G 2360/144* (2013.01)

(58) Field of Classification Search
CPC .... G09G 5/10; G09G 5/02; G09G 2320/0626; G09G 2320/0666; G09G 2330/023; G09G 2354/00; G09G 2360/144
See application file for complete search history.

(56) References Cited

U.S. PATENT DOCUMENTS 6,909,486 B2 6/2005 Wang et al.
6,961,108 B2 11/2005 Wang et al.
8,325,198 B2 12/2012 Klompenhouwer et al.
(Continued)

OTHER PUBLICATIONS

Invitation to Pay Additional Fees of the International Searching Authority; PCT/US2019/064983; dated Feb. 24, 2020; 22 Pages; European Patent Office.

(Continued)

*Primary Examiner* — Wing H Chow
(74) *Attorney, Agent, or Firm* — William J. Tucker

(57) ABSTRACT

A method, of reducing display device energy consumption, including: (a) determining lighting conditions ambient to a display device; (b) determining content that a user chooses to view on the display device; (c) calculating the user's perception of display quality using an image appearance model; and (d) adjusting, when the perceived display quality is higher than a target display quality, display device conditions so that the perceived display quality matches the target display quality so as to reduce energy consumption. An apparatus utilizing the method so as to reduce energy consumption while providing an aesthetically pleasing viewing experience to a user.

19 Claims, 6 Drawing Sheets

(56) References Cited

U.S. PATENT DOCUMENTS

| | | | | |
|---|---|---|---|---|
| 2005/0134547 | A1 | 6/2005 | Wyatt | |
| 2008/0186393 | A1 | 8/2008 | Lee et al. | |
| 2011/0074803 | A1 | 3/2011 | Kerofsky | |
| 2012/0081279 | A1 | 4/2012 | Greenebaum et al. | |
| 2013/0093783 | A1 | 4/2013 | Sullivan et al. | |
| 2013/0293121 | A1 | 11/2013 | Viacheslav | |
| 2015/0243200 | A1 | 8/2015 | Pan | |
| 2018/0171154 | A1* | 6/2018 | Basil et al. | G02B 1/10 |

OTHER PUBLICATIONS

Fairchild et al; "ICAM Framework for Image Appearance, Differences, and Quality"; Journal of Electronic Imaging; 13(1), 126-128 (2004.

Fairchild et al; "Meet ICAM: A Next-Generation Color Appearance Model"; IS&T/SID Tenth Color Imaging Conference; (2002); 6 Pages.

Invitation to Pay Additional Fees of the International Searching Authority; PCT/US2019/055287; dated Dec. 12, 2019; 19 Pages; European Patent Office.

Johnson et al; "Rendering HDR Images"; RIT Scholar Works; (2003); 8 Pages.

Kim et al; "Emerging Technologies for the Commercialization of AMOLED TVS." Inf. Display 25.9 (2009): 18-22.

Kuang et al; "ICAM06: A Refined Image Appearance Model for HDR Image Rendering"; J. Vis. Commun. R., 18 (2007) 406-414.

Li et al; "The Performance of CIECAM02"; IS&T/SID Tenth Color Imagaing Conference; 2001; 5 Pages.

Moroney et al; "The CIECAM02 Color Appearance Model"; RIT Scholar Works; (2002); 7 Pages.

Oliver et al; "An Improved Technique for Determining Hardness and Elastic Modulus Using Load and Displacement Sensing Indentation Experiments"; J. Mater. Res., vol. 7, No. 6, 1992, 1564-1583.

Oliver et al; "Measurement of Hardenss and Elastic Modulus by Instrument Indentation: Advances in Understanding and Refinements to Methodology", J. Mater. Res., vol. 19, No. 1, 2004, 3-20.

Wu et al; "Proposed Modification to the CIECAM02 Colour Appearance Model to Include the Simultaneous Contrast Effects"; Color Research and Application; vol. 32(2) (2007) pp. 121-129.

* cited by examiner

METHODS FOR ACHIEVING, AND APPARATUS HAVING, REDUCED DISPLAY DEVICE ENERGY CONSUMPTION

This application claims the benefit of priority under 35 U.S.C. § 119 of U.S. Provisional Application Ser. No. 62/746,811, filed on Oct. 17, 2018, the content of which is relied upon and incorporated herein by reference in its entirety.

BACKGROUND

Field

The present disclosure relates generally to display devices and, more particularly, to methods for achieving, and display devices having, reduced energy consumption.

Technical Background

Electronic devices, for example, smartphones, smart watches, tablets, and laptop computers, have display devices that consume energy. Typically, these display devices will run on a portable energy source, for example a battery. It is a source of user frustration when the portable energy source capacity is consumed quickly and frequent charging events are performed typically at a fixed external energy source, for example an electrical outlet in a user's home. Further, the time taken for charging events reduces the time a user can utilize the electronic device, and/or the time the user can utilize the electronic device away from a fixed external energy source. Thus, there is a need for an electronic device having a display device with reduced energy consumption so as to prolong the time an electronic device can be used with a portable energy source. Although there have been methods of reducing display brightness to reduce energy consumption, such methods sacrifice display image quality by reducing brightness. Yet users typically do not want to sacrifice display image quality or device functionality in order to prolong energy source life. Thus, there is a need for an electronic device having a display device with reduced energy consumption without a reduction in display image quality.

SUMMARY

The present disclosure describes methods of achieving, and electronic devices having, display devices with an aesthetically pleasing viewing experience to the user while also achieving reduced energy consumption. The display device has low reflection characteristics. Anti-reflection coatings are known in the art, and have been applied to electronic devices. However, these devices, even the ones which have included anti-reflection coatings, have not functioned so as to maintain the user's perceived display image quality under varying ambient lighting conditions, while also maximizing the battery life and/or minimizing the energy consumption of the display device. Thus, there is a need for methods to achieve the combined objectives of aesthetically pleasing user viewing experience and reduced energy consumption and/or prolonged battery life.

The present disclosure describes methods of using and/or programming an electronic device, and an electronic device, having a display that is coated with an anti-reflection coating. The anti-reflection coating preferably has a high hardness, a low reflectance, and a low color shift with angle. The anti-reflection coating enables operation of the display so as to provide an aesthetically pleasing viewing experience to the user while also reducing energy consumption. The high hardness provides durability to the device. That is, if the anti-reflection coating is scratched or otherwise damaged, the viewing experience is degraded, and the reflectance thereof may be increased thereby reducing the effectiveness of the techniques of the present disclosure to reduce energy consumption. The methods described herein utilize one or more of the characteristics of the ambient lighting (including illuminance and/or color gamut, for example), the display reflectance, the display luminance, the type of content being viewed on the display (including video, movie, pictures, graphics, text, and/or email, for example), and/or an image appearance model for calculating a user's perception of the display quality (in terms of the user's perceived brightness, user's perceived contrast, and/or user's perceived color saturation of the content, as a function of display reflectance, ambient lighting conditions, and/or content type, for example), to minimize the energy consumption of the display while still delivering an aesthetically pleasing content viewing experience to the user. This method, and apparatus employing the method, thus delivers reduced energy consumption and/or longer battery life for a device without sacrificing the user's viewing experience (considering ambient lighting, display content, display reflectance, display luminance, user's perceived brightness, user's perceived contrast, user's perceived color saturation of the content, and/or content type). The method may be programmed into, and carried out by, a display device controller.

The accompanying drawings are included to provide a further understanding of the principles described, and are incorporated in and constitute a part of this specification. The drawings illustrate one or more embodiment(s), and together with the description serve to explain, by way of example, principles and operation of those embodiments. It is to be understood that various features disclosed in this specification and in the drawings can be used in any and all combinations. By way of non-limiting example the various features may be combined with one another as set forth in the following Embodiments:

Embodiment 1. A method, of reducing display device energy consumption, comprising:

a. determining lighting conditions ambient to a display device,
b. determining content that a user chooses to view on the display device,
c. calculating the user's perception of display quality using an image appearance model,
d. adjusting, when the perceived display quality is higher than a target display quality, display device conditions so that the perceived display quality matches the target display quality so as to reduce energy consumption.

Embodiment 2. The method of Embodiment 1, wherein the ambient lighting conditions comprise illuminance.

Embodiment 3. The method of Embodiment 1 or Embodiment 2, wherein the ambient lighting conditions comprise color.

Embodiment 4. The method of any one of Embodiments 1-3, wherein the ambient lighting conditions are actively sensed by the display device Embodiment 5. The method of any one of Embodiments 1-4, wherein the content comprises one or more of video, movie, pictures, graphics, text, email.

Embodiment 6. The method of any one of Embodiments 1-5, wherein the target display quality is determined using the image appearance model.

Embodiment 7. The method of any one of Embodiments 1-6, wherein the image appearance model approximates the user's perceived brightness, contrast, or color saturation of the content.

Embodiment 8. The method of any one of Embodiments 1-7, wherein the image appearance model is a function of the display device reflectance, the ambient lighting conditions, and the content.

Embodiment 9. The method of any one of Embodiments 1-8, wherein the display device operating conditions comprise luminance output.

Embodiment 10. The method of any one of Embodiments 1-9, wherein the display device operating conditions comprise color gamut.

Embodiment 11. The method of any one of Embodiments 1-10, wherein adjusting the display device operating conditions is a function of display device reflectance.

Embodiment 12. The method of Embodiment 11, wherein the display device reflectance is actively sensed by the display device.

Embodiment 13. The method of any one of Embodiments 1-12, wherein the display device comprises a total reflectance of 3% or less.

Embodiment 14. The method of any one of Embodiments 1-13, wherein the display device comprises a cover substrate comprising a first-surface reflectance of 1% or less.

Embodiment 15. The method of Embodiment 14, wherein the cover substrate comprises a surface having a maximum hardness of 10 GPa or more over indentation depths from 100-500 nm.

Embodiment 16. The method of Embodiment 14, wherein the cover substrate comprises a surface having a maximum hardness of 12 GPa or more over indentation depths from 100-500 nm.

Embodiment 17. A display device, having reduced energy consumption, comprising:

a housing comprising a front surface, a back surface and side surfaces; and electrical components at least partially within the housing, the electrical components comprising a controller, a memory, and a display, the display at or adjacent the front surface of the housing;

the controller being programmed to:

a. determine lighting conditions ambient to the display device, b. determine content that a user chooses to view on the display device, c. calculate the user's perception of display quality using an image appearance model, and d. adjust, when the perceived display quality is higher than a target display quality, display device conditions so that the perceived display quality matches the target display quality so as to reduce energy consumption.

Embodiment 18. The display device of Embodiment 17, wherein the ambient lighting conditions comprise illuminance.

Embodiment 19. The display device of Embodiment 17 or Embodiment 18, wherein the ambient lighting conditions comprise color.

Embodiment 20. The display device of any one of Embodiments 17-19, wherein the ambient lighting conditions are actively sensed by the display device.

Embodiment 21. The display device of any one of Embodiments 17-20, wherein the content comprises one or more of video, movie, pictures, graphics, text, email.

Embodiment 22. The display device of any one of Embodiments 17-21, wherein the target display quality is determined using the image appearance model.

Embodiment 23. The display device of any one of Embodiments 17-22, wherein the image appearance model approximates the user's perceived brightness, contrast, or color saturation of the content.

Embodiment 24. The display device of any one of Embodiments 17-23, wherein the image appearance model is a function of the display device reflectance, the ambient lighting conditions, and the content.

Embodiment 25. The display device of any one of Embodiments 17-24, wherein the display device operating conditions comprise luminance output.

Embodiment 26. The display device of any one of Embodiments 17-25, wherein the display device operating conditions comprise color gamut.

Embodiment 27. The display device of any one of Embodiments 17-26, wherein adjusting the display device operating conditions is a function of display device reflectance.

Embodiment 28. The display device of Embodiment 27, wherein the display device reflectance is actively sensed by the display device.

Embodiment 29. The display device of any one of Embodiments 17-28, wherein the display device comprises a total reflectance of 3% or less.

Embodiment 30. The display device of any one of Embodiments 17-29, wherein the display device comprises a cover substrate comprising a first-surface photopic average reflectance of 1% or less over an optical wavelength regime from about 380 nm to about 720 nm.

Embodiment 31. The display device of Embodiment 30, wherein the cover substrate comprises a surface having a maximum hardness of 10 GPa or more over indentation depths from 100-500 nm.

Embodiment 32. The display device of Embodiment 30, wherein the cover substrate comprises a surface having a maximum hardness of 12 GPa or more over indentation depths from 100-500 nm.

Embodiment 33. The display device of Embodiment 30, wherein the display device further comprises a contrast ratio (CR) of at least 5 at a display luminance of 200 cd/m$^2$ under an ambient light illuminance of 1,000 lux.

Embodiment 34. The display device of Embodiment 30, wherein the display device further comprises a calculated perceptual contrast length (PCL) of at least 20 at a display luminance of 200 cd/m$^2$ under an ambient light illuminance of 1,000 lux.

Embodiment 35. The display device of any one of Embodiments 17-29, wherein the display device comprises a cover substrate, the cover substrate comprising an anti-reflection coating, and further wherein the cover substrate comprises a first-surface photopic average reflectance of 0.5% or less over an optical wavelength regime from about 380 nm to about 720 nm.

Embodiment 36. The Embodiment of 35, wherein the display device further comprises a contrast ratio (CR) of at least 5 at a display luminance of 200 cd/m$^2$ under an ambient light illuminance of 1,000 lux.

Embodiment 37. The Embodiment of 35, wherein the display device further comprises a calculated perceptual contrast length (PCL) of at least 20 at a display luminance of 200 cd/m$^2$ under an ambient light illuminance of 1,000 lux.

The embodiments, and the features of those embodiments, as discussed herein are exemplary and can be provided alone or in any combination with any one or more features of other embodiments provided herein without departing from the scope of the disclosure. Moreover, it is to be understood that both the foregoing general description and the following detailed description present embodiments of the disclosure, and are intended to provide an overview or framework for understanding the nature and character of the embodiments as they are described and claimed. The accompanying drawings are included to provide a further understanding of the embodiments, and are incorporated into and constitute a part of this specification. The drawings illustrate various embodiments of the disclosure, and together with the description, serve to explain the principles and operations thereof.

DETAILED DESCRIPTION

Figure 1:
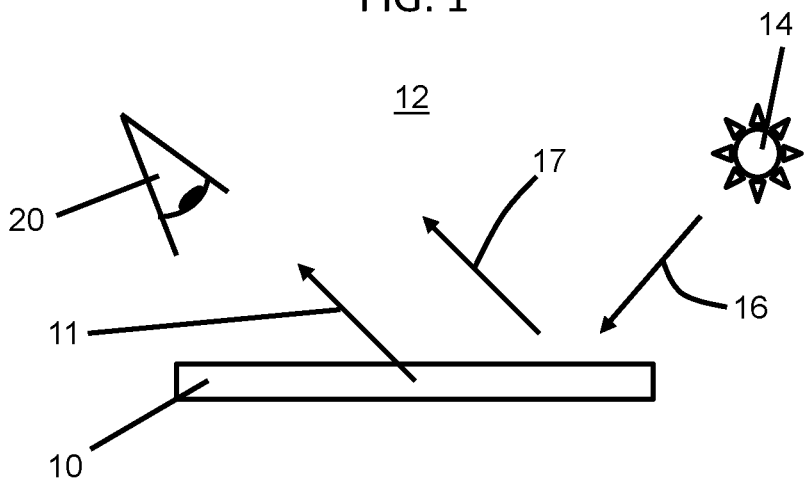
FIG. 1 is a schematic representation of a display device in ambient conditions as viewed by a user, according to some embodiments.

In the following detailed description, for purposes of explanation and not limitation, example embodiments disclosing specific details are set forth to provide a thorough understanding of various principles and aspects. However, it will be apparent to one having ordinary skill in the art, having had the benefit of the present disclosure, that the claimed subject matter may be practiced in other embodiments that depart from the specific details disclosed herein. Moreover, descriptions of well-known devices, methods and materials may be omitted so as not to obscure the description of various principles set forth herein. Finally, wherever applicable, like reference numerals refer to like elements.

The present disclosure sets forth a method of using and/or programming an electronic device having a display device that has a cover substrate coated with an anti-reflection coating. The anti-reflection coating preferably has: a high maximum hardness, for example 10 GPa or greater, or 12 GPa or greater, measured using the Berkovich Hardness test as described herein; a low reflectance, including a single surface reflectance of 1% or less, (for example 0.9% or less, or 0.8% or less, or 0.7% or less, or of 0.6% or less), as a photopic visible average; and/or a low color shift with angle (for example 10 or less, or 5 or less, or 3 or less) for both a* and b* color metrics for all viewing angles from 0-60 degrees from normal (wherein normal is perpendicular to the surface of the display device). As used herein "normal" includes normal viewing angle and "near normal" viewing angles, which are defined as up to 10 degrees from normal. As used herein "reflectance" refers to photopic average reflectance unless specified otherwise. "Reflectance" may refer to specular reflectance, or may refer to specular+diffuse reflectance. A display surface that reduces the specular reflectance from the display, for example a roughened or light-scattering 'anti-glare' surface, may also be utilized in the methods of this disclosure, in addition to the generally non-scattering 'anti-reflection' surfaces described in the most detail here. "First-surface reflectance" refers to the reflected light from the surface of the display that is closest to the user. This first surface may be coated or have some microstructure that can be described as having multiple reflections from the standpoint of detailed optical models, but from a practical user and measurement perspective, the front surface is commonly measured as a single interface between air and the article. "Total reflectance" refers to reflected light from both the front surface and the back surface or buried surfaces of an article or display device.

The method takes into account the factors of ambient lighting, display reflectance, content being viewed on the display, and image appearance-based modeling of user perceived brightness, contrast, and/or color to adjust the energy usage and power consumption of the display while still delivering an acceptable aesthetically pleasing content viewing experience to the user. The specific target display quality depends on levels of brightness, contrast, and color, which may be application-specific (e.g. may be different for smartwatches, smartphones, tablets, or laptop computers). The general method applies regardless of the specific target display quality levels, which may be established by users, human factors studies, application, and/or the experience of display designers.

Methods and apparatus will now be described more fully hereinafter with reference to the accompanying drawings in which exemplary embodiments of the disclosure are shown. Whenever possible, the same reference numerals are used throughout the drawings to refer to the same or like parts. However, this disclosure may be embodied in many different forms and should not be construed as limited to the embodiments set forth herein.

Display luminance, contrast, and color gamut represent the image and light being emitted by the display itself, while ambient lighting represents light shining onto the display from an external source (such as room lights or the sun) which can reflect from the display and effect the viewable or measurable optical performance of the display.

FIG. 1 is a schematic diagram of a display device 10 in an ambient environment 12 having a light source 14. Light source 14 emits light (depicted by ray 16) creating a particular illuminance value at the display surface. The emitted light 16 is reflected from the display device 10 back toward the eye 20 of a user as indicated by ray 17 having a luminance (RL). The display, when on, also emits light (depicted by ray 11) having a particular luminance value (DL). The user's eye 20 perceives the display as having a luminance that is affected by the light 16 and reflected light 17.

The display contrast ratio (CR) is conventionally defined as the ratio of display luminance in the fully on "white" state (Lw) to the display luminance in the fully off "black" state (Lb), i.e. CR=Lw/Lb. More specifically, when the display is turned off it shows as black. However, even when the display shows black, the black is perceived by the user's eye 20 as having luminance (Lb) from the reflected light 17 (RL). When the display is "on" and showing "white", the white is perceived by the user's eye 20 as having luminance (Lw) which is the luminance DL plus luminance RL from the reflected light 17. The ratio between the luminance Lw of the "white" display condition to the luminance Lb of the "black" display condition is called absolute contrast ratio (CR). Expressed as equation (1), then:

$$CR=Lw/Lb \quad (1)$$

Substituting the values for Lw and Lb into equation (1), there is derived equation (2):

$$CR=(RL+DL)/(RL) \quad (2).$$

Expanding equation (2) yields equation (3):

$$CR=1+(DL/RL) \quad (3).$$

From equation (3) it is seen that CR decreases as RL increases, and/or increases as DL increases. However, increasing DL leads to use of more energy, which leads to reduced power source life. On the other hand, decreasing RL does not consume more energy from the power source. Accordingly, as set forth below in connection with FIG. 2, using an anti-reflective coating on the display device (or otherwise reducing the reflectance of the display device so as to produce a low-reflectance display) can be utilized to reduce energy consumption of the display device.

Under ambient lighting, the CR for a low-reflectance display is higher primarily because the display reflects less of the ambient light, making Lb smaller (the blacks of the display appear to be more black), which increases CR. Secondarily, the low-reflectance display can transmit more light, making Lw slightly higher. Lb tends to have the larger impact on CR in this scenario.

Figure 2:
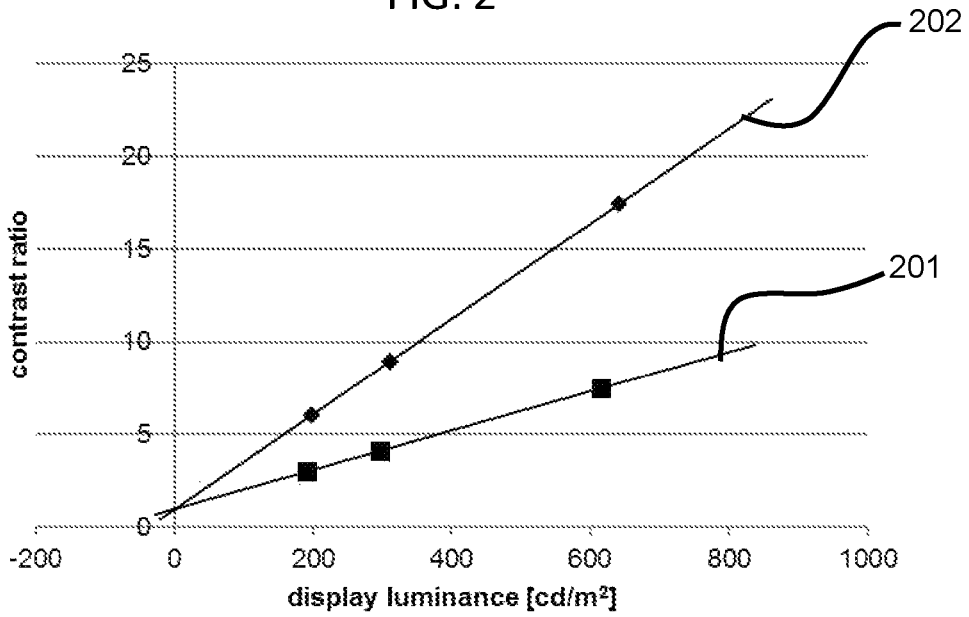
FIG. 2 is a graph of contrast ratio (y-axis) versus display luminance (x-axis) for display devices Display 1 and Display 2 having different reflectance, according to some embodiments.

FIG. 2 is a graph of contrast ratio (CR) versus display luminance in candela per meter squared (cd/m$^2$) for two different displays with an ambient lighting of 1000 lux illuminance. Unless otherwise noted, the display luminance levels were measured at a 20° angle from the normal axis of the display. Line 201 depicts the relationship for a first display (Display 1) having a cover substrate of Corning® Gorilla® glass with no coating thereon. Display 1 has a first-surface photopic average reflectance of about 4%, as measured at a near-normal incidence ~6°. On the other hand, Line 201 depicts the relationship for a second display (Display 2) having a cover substrate of Corning® Gorilla® glass having an optical coating thereon. Display 2 has a first-surface photopic average reflectance of about 0.7%, as measured at a near-normal incidence of ~6°. The two displays are identical, except for their front surface reflectance. As can be seen from FIG. 2, Display 2 can achieve the same CR as Display 1 but using less luminance. More specifically, for a CR of about 5, Display 1 uses a luminance of about 400 cd/m$^2$, whereas Display 2 uses a luminance of less than 200 cd/m$^2$. Using this understanding, conceptually, display image quality can be related to energy, power, and battery life savings. Since CR is a simple ratio Lw/Lb, for a reduced Lb, such as can be achieved with a low reflectance display, the Lw can be reduced by a similar factor as Lb is reduced, and the realized CR will be the same. Thus, if Lb under ambient lighting can be reduced by a factor of 2 due to lower reflectance, then Lw (the luminance output of the display) can also be reduced by a similar factor of 2, e.g. from 400 cd/m$^2$ to 200 cd/m$^2$, while preserving a similar CR.

Figure 3A:
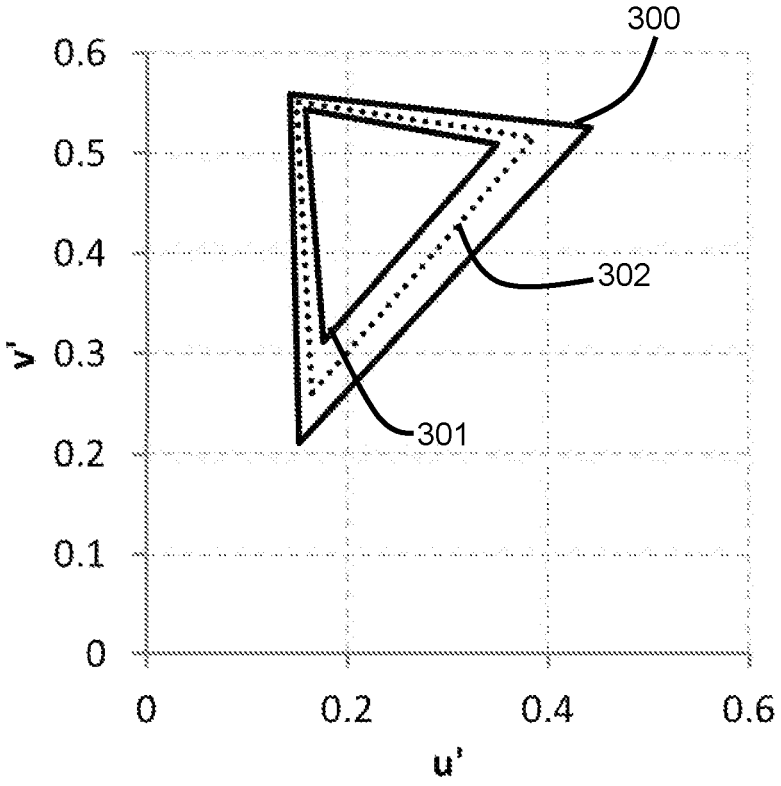
FIGS. 3A and 3B are color gamut depictions for display devices Display 1 and Display 2 under different ambient lighting conditions, according to some embodiments.
Figure 3B:
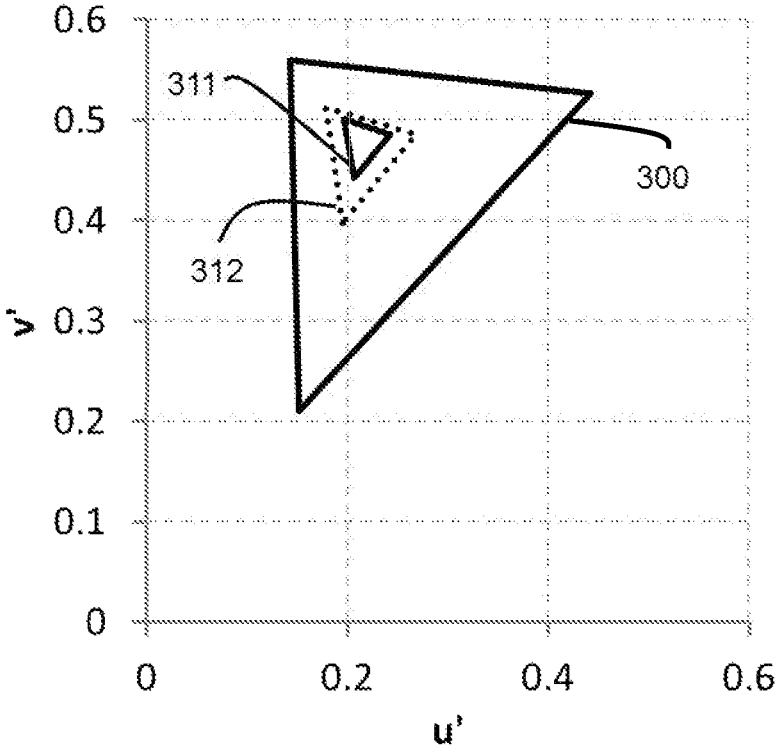

In addition to CR improvements, the color gamut of the display under ambient lighting is improved with the low-reflectance second display, as illustrated in FIGS. 3A and 3B. This is because the ambient lighting tends to "wash out" the color saturation of the images being displayed from the display. Accordingly, lowering the reflectance of ambient light (by providing a display device having a low reflectance) reduces this washout effect, increasing the color gamut for a given ambient lighting level thereby increasing the aesthetic appearance of the display. The effect of washing out the color saturation is demonstrated by FIGS. 3A and 3B.

FIGS. 3A and 3B show the color gamut depictions (in International Commission on Illumination (CIE) 1976 L*, u*, v* color space, commonly known by its abbreviation CIELUV) of Display 1 and Display 2 under different ambient lighting levels. More specifically, FIG. 3A shows the color gamut depictions for an ambient illuminance of 1,000 lux, whereas FIG. 3B shows the same color gamut depictions for an ambient illuminance of 10,000 lux, wherein: 20-50 lux roughly corresponds to dim indoor lighting; 320-500 lux roughly corresponds to bright office lighting; 1000 lux roughly corresponds to a cloudy day outdoors; 10,000-25,000 lux roughly corresponds to full daylight on a clear day outdoors but not in direct sun; and 32,000-100,000 lux roughly corresponds to direct sunlight outdoors. The area 300 represents "dark", wherein "dark" means no ambient illumination, and/or ambient illuminance is set to zero lux. So, no light is reflected from the display in the dark condition, which is a reference and/or baseline and/or control condition for comparison, as in each case (Display 1 or Display 2) the display is not washed out when there is no ambient illuminance. Thus, in FIG. 3A, the area 301 denotes how a user would perceive the color gamut of Display 1 (set at a luminance of 620 cd/m$^2$) under an ambient illuminance of 1000 lux, whereas area 302 denotes how a user would perceive the color gamut of Display 2 (set at a luminance of 640 cd/m$^2$, and under the same ambient illuminance of 1000 lux). Comparing areas 301 and 302, it is seen that the color gamut of Display 2 is perceived broader than that of Display 1. Similarly, in FIG. 3B, the area 311 denotes how a user would perceive the color gamut of Display 1 (set at a luminance of 620 cd/m$^2$) under an ambient illuminance of 10,000 lux, whereas area 312 denotes how a user would perceive the color gamut of Display 2 (set at a luminance of 640 cd/m$^2$, and under the same ambient illuminance of 10,000 lux). Comparing areas 311 and 312, it is seen that the color gamut of Display 2 is perceived broader than that of Display 1. In order to increase the color saturation of Display 1 relative to Display 2 under the same ambient lighting conditions, one could increase the luminance of Display 1, but doing so would decrease battery life. Alternatively, if the color saturation of Display 1 was adequate for a particular user, the luminance of Display 2 could be reduced so that the color saturation of Display 2 trends toward that of Display 1, whereby battery life could be enhanced and/or the energy consumption of Display 2 could be reduced. Accordingly, use of a low-reflectance display (for example Display 2) can enhance the appearance of the display, providing an aesthetically pleasing viewing experience to the user, and/or can reduce energy consumption.

Figure 4:
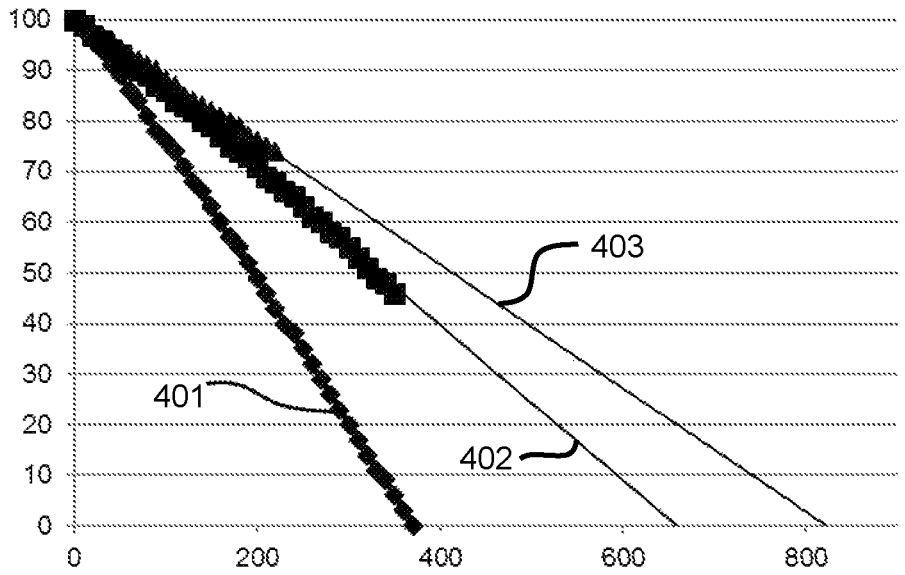
FIG. 4 is a graph of battery life (in percent on the y-axis) versus time (in minutes on the x-axis), according to some embodiments.
Figure 5:
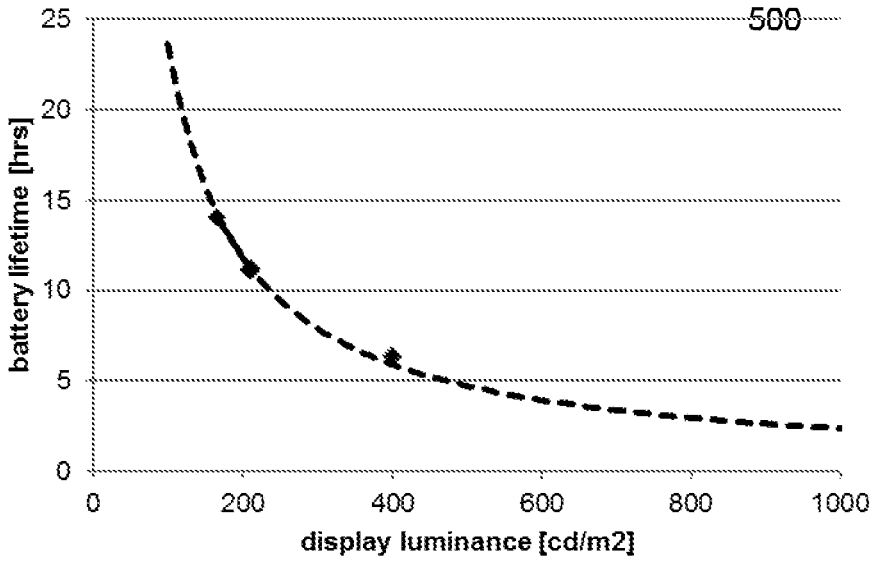
FIG. 5 is a graph of battery life (in hours on the y-axis) versus display luminance (in cd/m$^2$ on the x-axis), according to some embodiments.

The effect of changing display luminance—so as to adjust for CR and color gamut changes that accommodate the ambient conditions—on battery life are depicted in FIGS. 4 and 5. Specifically, FIG. 4 plots battery level for a Samsung Galaxy S8 smartphone (in % on the y-axis) versus time (in minutes on the x-axis) for display luminance of 400 cd/m$^2$ (line 401), 211 cd/m$^2$ (line 402), and 167 cd/m$^2$ (line 403). The smartphone was operated in airplane mode to isolate the effects of display luminance. When the display luminance was set to 400 cd/m$^2$, battery level reached 0% after about 360 minutes (about 6 hours), i.e., the point where line 401 meets the x-axis. Similarly when display luminance was set to 211 cd/m$^2$, battery level reached 0% after about 660 minutes (about 11 hours), i.e., the point where line 402 meets the x-axis. And when display luminance was set to 167 cd/m$^2$, battery level reached 0% after about 800 minutes (more than 13 hours), i.e., the point where line 403 meets the x-axis. Although the display power consumption is one component relating to battery life in a complex device like a smartphone, the display can be a significant element affecting battery life. A reduction in display luminance from 400 cd/m$^2$ to 211 cd/m$^2$ is shown to increase the device battery life from about 6 hours (about 360 minutes) to about 11 hours (about 660 minutes). Recall from FIG. 2, and the discussion thereof, that when the display is suitably anti-reflective, a user will perceive the CR of a display at luminance of 211 cd/m$^2$ to have the same or slightly better CR as a high-reflectance display at a luminance of 400 cd/m$^2$. Accordingly, to increase battery life and/or reduce energy consumption, an anti-reflective coating may be disposed on the cover substrate of a display or at another suitable location in the display so as to reduce the reflectance thereof. Stated another way, a display having low reflectance can be used in a manner (for example, by reducing luminance) so as to prolong battery life while still providing an aesthetically pleasing viewing experience to the user. FIG. 5 shows another manner of looking at the same concept as demonstrated with FIG. 4. More specifically, FIG. 5 plots a 1/× fit of the same data as in FIG. 4, i.e., battery lifetime in hours on the y-axis versus display luminance (cd/m$^2$) on the x-axis. FIG. 5 shows that: for a display luminance of 400 cd/m$^2$, the battery lifetime is about 6 hours; for a display luminance of slightly more than 200 cd/m$^2$, the battery lifetime is about 11 hours; and for a display luminance of about 160 cd/m$^2$, the battery lifetime is greater than about 12½ hours. The 1/× dependence allows one to predict the battery savings for an arbitrary reduction of the luminance. For example, if the luminance is decreased by 20% (that is, to 80% of its original value by using the concepts discussed herein), the lifetime is increased by 1/0.8=1.25 or a 25% increase, which is a rather large increase according to today's standards, wherein an increase of 4 or 5% is considered quite significant.

Basic contrast ratio is one measurement of display performance. Again, there is a desire to maintain an aesthetically pleasing viewing experience for the user. Accordingly, together with utilizing the basic contrast ratio to reduce display luminance, and thereby increase battery lifetime, there is used a metric to moderate the luminance adjustment so as to maintain an aesthetically pleasing viewing experience for the user. The metric combines various elements that go into a user's perception of display performance and quality, for example perceived contrast ratio, perceived brightness, and perceived color gamut, including the changes to the user's eyes and perception that can be caused by ambient environment and displayed content. One metric of human perception of contrast is perceptual contrast length (PCL), which uses a perceived brightness metric $B_Q$. Various methods exist to calculate PCL, and other metrics may be developed (other than PCL and $B_Q$) to describe the human perception of contrast and brightness. Generally, all of these metrics, when applied to displays, will rely primarily on the white screen luminance, dark screen luminance, and ambient illumination level (which may be incorporated into the model through reflected light affecting the white and dark screen luminance). Our PCL data reported here therefore includes the basic data needed (white screen luminance as reported, dark screen luminance derived from simple ratio of (white screen luminance)/(ACR), and ambient illuminance as reported. We have found that the display readability advantages described here using ACR are similar when using PCL metrics, i.e. using PCL values as a display target allows for comparable reductions in display brightness leading to comparable battery lifetime and energy consumption improvements.

Unless otherwise noted, the perceptual contrast length (PCL) reported in this disclosure is defined under CIECAM02, the color appearance model published in 2002 by the CIE Technical Committee 8-01. A higher PCL value corresponds to higher perceived image quality from a real world user perspective. An alternate image appearance model is iCAM06, as described in the article "iCAM06: A refined image appearance model for HDR image rendering" by Kuang et al., J. Vis. Commun. Image R. vol. 18 (2007) pages 406-414, Elsevier Incorporated. The present techniques for enhancing battery life do not depend on the specific image appearance model that is used, which can depend on the specific application, designer and user preferences. Further, the models can be updated over time as new data and understanding is incorporated. Any of these models, or similar models can be used in the presently described embodiments to calculate the user's perception of display image quality, viewability, or readability under varying ambient light conditions. In some embodiments, the model employed incorporates the following targets: the user's perception of display brightness, user's perception of contrast, and/or user's perceived color saturation of the content. In some embodiments, the model may also or alternatively include as inputs the ambient light level, the color of the ambient lighting, the display reflectance, and the type of content being shown on the display.

Figure 6A:
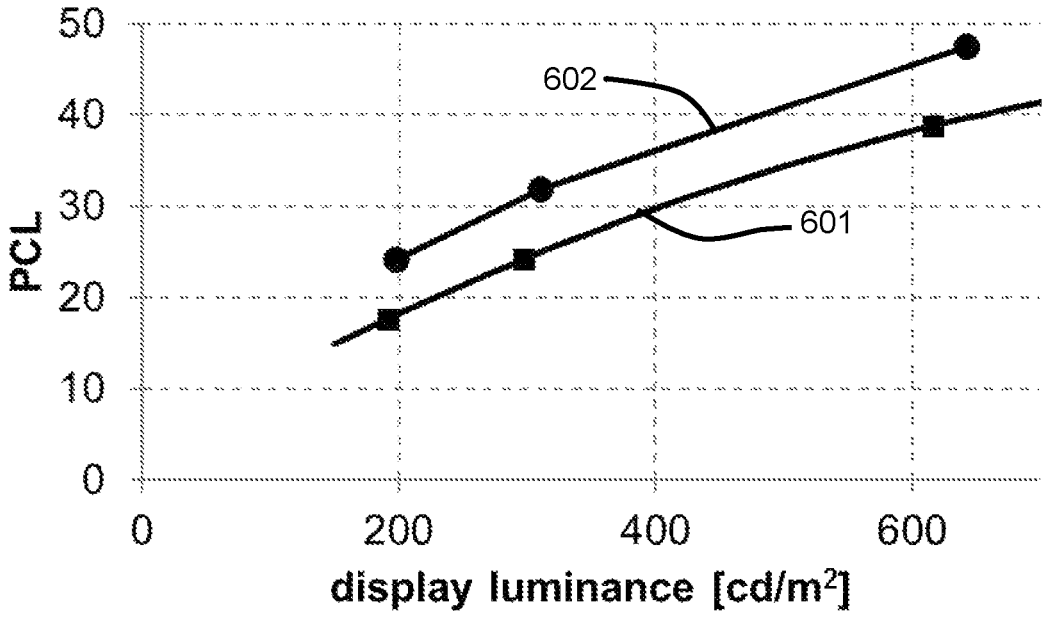
FIGS. 6A and 6B are graphs of PCL (on the y-axis) versus display luminance (in cd/m$^2$ on the x-axis) for display devices Display 1 and Display 2 under different ambient conditions.
Figure 6B:
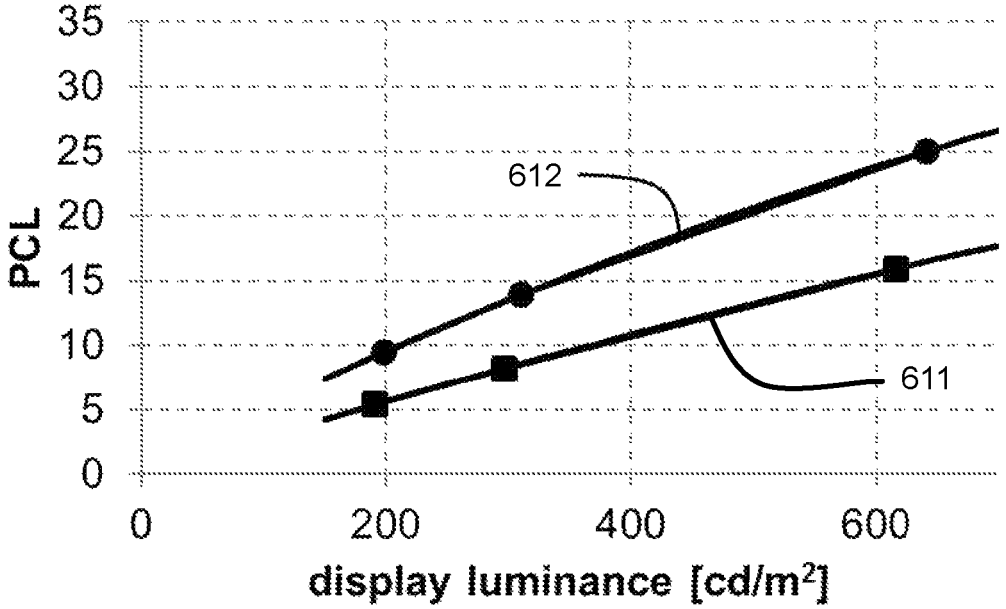

FIGS. 6A and 6B depict, using a parabolic fit to the data of the calculated perceptual contrast length (PCL) for two different displays, namely, the above-described Display 1 having front surface reflectance of about 4%, and the above-described Display 2 having first surface reflectance of about 0.7%. The points represent measured values that go through the color appearance model, CIECANI02 to generate the Brightness, Q. The difference between the Brightness Q for white and the Brightness Q for black is the PCL, which is plotted in these figures. A parabolic fit was used because the data is nonlinear in the display luminance. As shown in FIGS. 6A and 6B, the PCL is enhanced for Display 2 having lower reflectance than Display 1 under bright ambient lighting conditions from 1000-10,000 lux. More specifically, FIG. 6A shows the PCL for Display 1 (line 601) and the PCL for Display 2 (line 602) for an ambient illuminance of 1,000 lux. As seen in FIG. 6A, the line 602 is higher than line 601 across display luminance from about 200 to more than 600 cd/m$^2$. Accordingly, Display 2 (having lower reflectance than Display 1) has a higher PCL than does Display 1 (having a higher reflectance than Display 2). Similarly, FIG. 6B shows the PCL for Display 1 (line 611) and the PCL for Display 2 (line 612) for an ambient illuminance of 10,000 lux. As seen in FIG. 6B, the line 612 is higher than line 611 across display luminance from about 200 to more than 600 cd/m$^2$. Accordingly, Display 2 (having lower reflectance than Display 1) has a higher PCL than does Display 1 (having a higher reflectance than Display 2). Also seen in both FIGS. 6A and 6B is that the difference in PCL for a given display luminance (i.e., distance in the y-direction between the lines 601 and 602, and/or 611 and 612) increases as display luminance increases.

Figure 7:
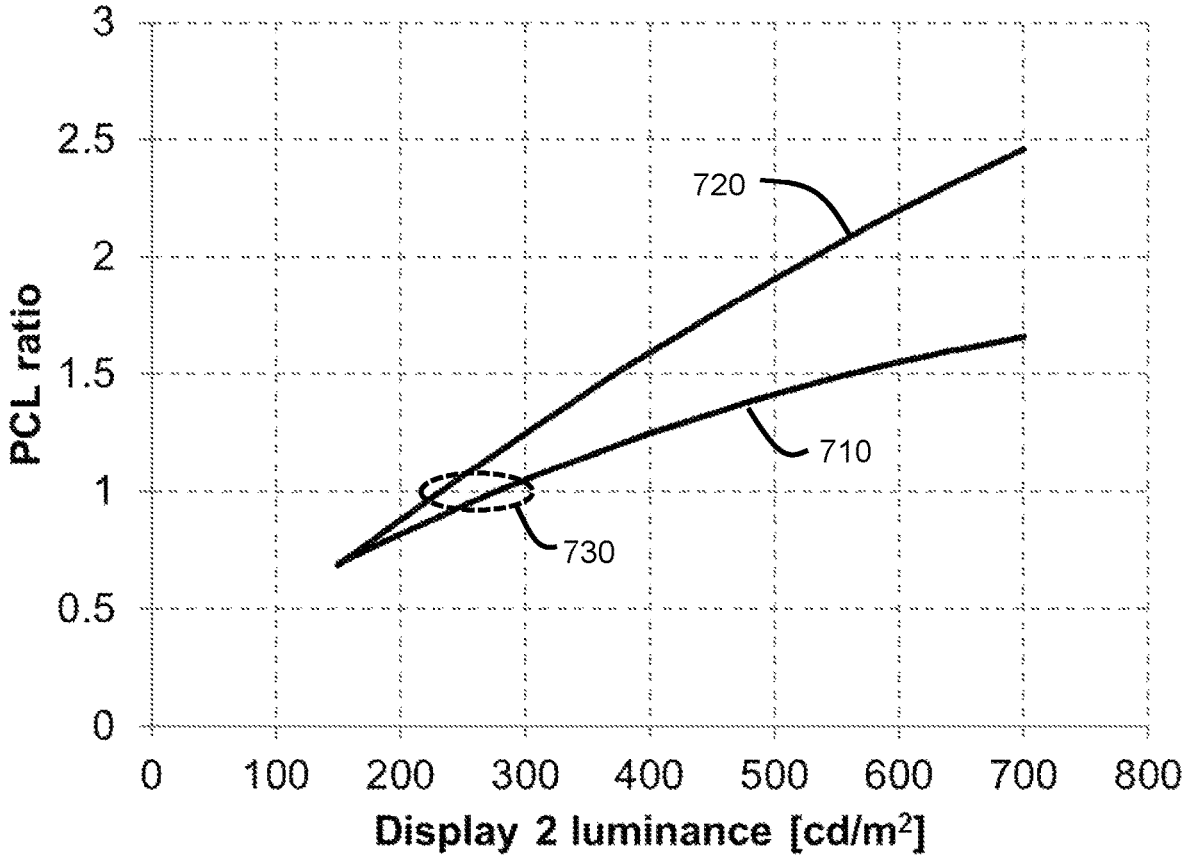
FIG. 7 is a PCL ratio (on the y-axis) versus Display 2 luminance (in cd/m$^2$ on the x-axis), according to some embodiments.

FIG. 7 summarizes the trends shown in FIGS. 6A and 6B by plotting the ratio of PCL of the low-reflectance Display 2 normalized to the PCL of the standard reflectance Display 1. More specifically, FIG. 7 shows a ratio of the PCL of Display 2 divided by PCL of Display 1 (when Display 1 is set to 400 cd/m$^2$ luminance) on the y-axis, versus luminance of Display 2 on the x-axis. When the PCL ratio in FIG. 7 is equal to or about 1, the PCL of the two displays is the same, and when the ratio in FIG. 7 is higher than 1, Display 2 has a higher PCL and/or higher perceived image quality than Display 1. FIG. 7 further illustrates that for this range of ambient lighting from 1000 lux (line 710)-10,000 lux (line 720), the luminance of Display 2 can be lowered to a range of 220-280 cd/m$^2$ (shown by dashed oval 730) and deliver comparable PCL to the standard Display 1 being set at 400 cd/m$^2$. That is, within the Display 2 luminance levels designated by the dashed oval 730, the PCL ratio remains about 1 Thus, the reduction in energy usage—from reduced display luminance, and the corresponding battery life increase—for the system employing Display 2 can be substantial as compared to a system using the standard Display 1. Further, and without being bound by theory, the trend in reduction of luminance associated with Display 2 observed at an illuminance of 1000 lux (line 710) and 10000 lux (line 720) would be expected at lower illuminance levels, e.g., from 200 lux to 1000 lux.

The above-described method can be: used by a device maker to program display device operating conditions; programmed into the display device itself; and/or used by an end consumer to modify, for example as by a programming algorithm, a display device operating conditions; so as to achieve a device with longer battery life (as compared to a device not using the present method) and provide an aesthetically pleasing viewing experience to the user of the display device.

To summarize, the method, process, programming algorithm, and or programmed display device, may incorporate the following steps or elements:

(1) obtaining a display device and/or cover substrate reflectance value. The reflectance value may be actively sensed or may be a fixed parameter based on the device manufacturing configuration. Preferably, the display device comprises a low-reflectance coated touch screen with, or otherwise has, a first-surface reflectance of 1% or less, a total reflectance (including buried interfaces) of 3% or less, and has maximum hardness of 10 GPa or more, for example 12 GPa or more, or 13 GPa or more, or 14 GPa or more, or 15 GPa or more, or 16 GPa or more, or 17 GPa or more, or 18 GPa or more, or 19 GPa or more, up to 50 GPa, over indentation depths from 100-500 nm;

(2) Obtaining ambient lighting levels and/or ambient lighting color. These ambient conditions may be actively sensed by sensors within the display article itself or provided to the display article from external sensors;

(3) Determining content that a user chooses to view on the display. The content may include video, movie, pictures, graphics, text, and/or email, for example. Different content consumes different amounts of energy in terms of the display device brightness, color levels, and in terms of controller use time;

(4) Calculating the user's perception of display quality using an image appearance model which calculates, approximates, or outputs the user's perceived brightness, user's perceived contrast, or user's perceived color saturation of the displayed images. The perceived display quality may then be compared to target levels of brightness, contrast, and color. The image appearance model may incorporate one or more of the above-mentioned display reflectance, ambient lighting, and display content assessed in steps 1-3; and (5) Adjusting, when the perceived display quality is higher than a target display quality, the display device conditions so that the perceived display quality matches the target display quality so as to reduce energy consumption. The display device conditions may include display luminance output and/or color, for example, while maintaining acceptable targeted user experience according to an image appearance model.

Figure 8A:
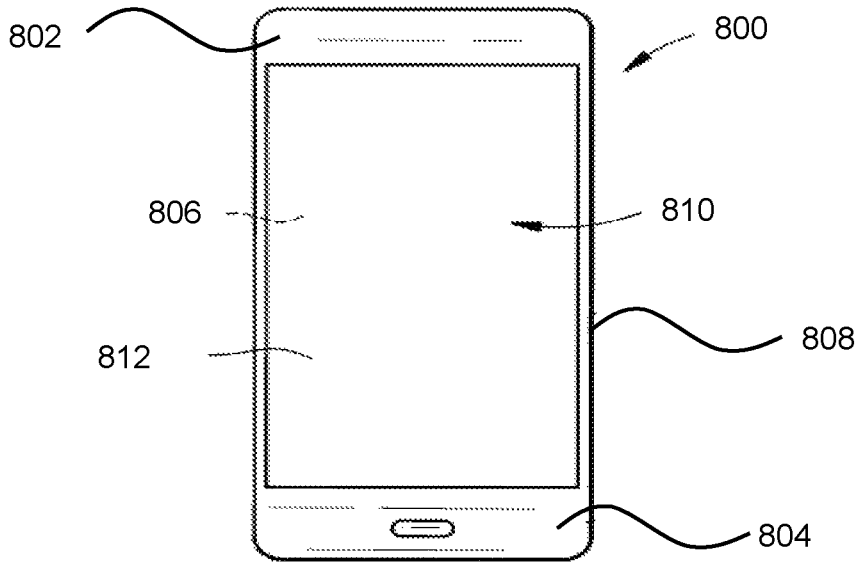
FIG. 8A is a plan view of an exemplary electronic device incorporating any of the display devices and/or coating stack designs disclosed herein, according to some embodiments.
Figure 8B:
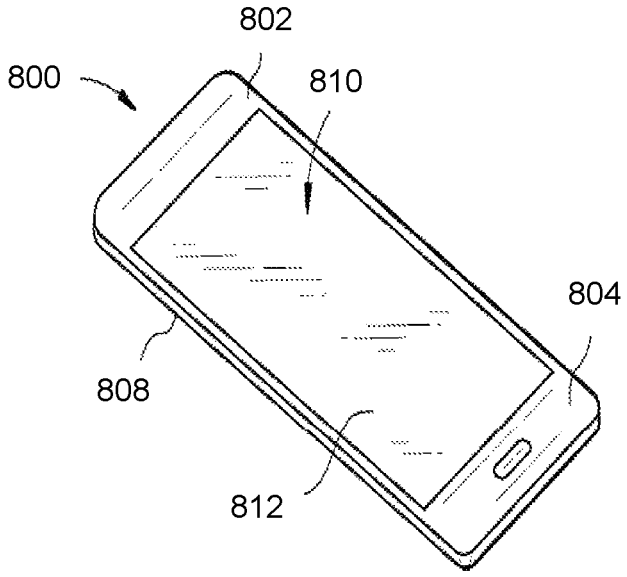
FIG. 8B is a perspective view of the exemplary electronic device of FIG. 8A.

The display devices disclosed herein may be incorporated into another article such as an article with a display (or display articles) (e.g., consumer electronics, including mobile phones, tablets, computers, navigation systems, wearable devices (e.g., watches) and the like), architectural articles, transportation articles (e.g., automotive, trains, aircraft, sea craft, etc.), appliance articles, or any article that benefits from improved display viewability, scratch-resistance, abrasion resistance or a combination thereof. An exemplary article incorporating any of the display devices and/or anti-reflective coatings disclosed herein is shown in FIGS. 8A and 8B. Specifically, FIGS. 8A and 8B show a consumer electronic device 800 including a housing 802 having front 804, back 806, and side surfaces 808; electrical components (not shown) that are at least partially inside or entirely within the housing and including at least a controller, a memory, and a display device 810 at or adjacent to the front surface of the housing; and a cover substrate 812 at or over the front surface of the housing such that it is over the display. In some embodiments, the cover substrate 812 is made to be a low-reflectance substrate giving the display a low-reflectance so that it may be used according to the principles described herein to enhance battery life and/or provide an aesthetically pleasing viewing experience to the user.

A display may be made to be low-reflectance in various manners. Four examples of a cover glass stack having low reflectance are described here.

Example 1

The as-fabricated samples of Example 1 ("Ex. 1") were formed by providing a glass substrate having a nominal composition of 67 mol % $SiO_2$, 4 mol % $B_2O3$, 13 mol % $Al_2O_3$, 14 mol % $Na_2O$, and 2 mol % MgO and disposing an anti-reflective coating having thirteen (13) layers on the glass substrate as shown in Table 1 below. The anti-reflective coating (e.g., as consistent with the anti-reflective coatings outlined in the disclosure) of each of the as-fabricated samples in this Example was deposited using a reactive sputtering process.

TABLE 1

Anti-reflective coating attributes for Example 1

| Layer | Material | Refractive Index | Ex. 1 Thickness (nm) |
|---|---|---|---|
| | Air | 1.0 | |
| 1 | $SiO_2$ | 1.48 | 90.5 |
| 2 | $Si_xN_y$ | 2.05 | 150.2 |
| 3 | $SiO_2$ | 1.48 | 16.6 |
| 4 | $Si_xN_y$ | 2.05 | 46.3 |
| 5 | $SiO_2$ | 1.48 | 9 |
| 6 | $Si_xN_y$ | 2.05 | 2000 |
| 7 | $SiO_2$ | 1.48 | 10.9 |
| 8 | $Si_xN_y$ | 2.05 | 37.3 |
| 9 | $SiO_2$ | 1.48 | 33 |

TABLE 1-continued

| Anti-reflective coating attributes for Example 1 | | | |
|---|---|---|---|
| | Material | Refractive Index | Ex. 1 Thickness (nm) |
| 10 | $Si_xN_y$ | 2.05 | 23.4 |
| 11 | $SiO_2$ | 1.48 | 53 |
| 12 | $Si_xN_y$ | 2.05 | 7.6 |
| 13 | $SiO_2$ | 1.48 | 25 |
| | Glass substrate | 1.51 | |
| Total thickness | | | 2502.8 |
| Reflected color | Y | | 0.7 |
| | L* | | |
| | a* | | |
| | b* | | |
| Hardness (GPa) | @ 100 nm depth | 12 | |
| | @ 500 nm depth | | |
| Max hardness | Hmax (GPa) | 18 | |
| | Depth (nm) | 900 | |
| Film stress | (MPa) | | |
| Surface roughness, $R_a$ | (nm) | | |

Example 2

The as-fabricated samples of Example 2 ("Ex. 2") were formed by providing a glass substrate having a nominal composition of 67 mol % $SiO_2$, 4 mol % $B_2O3$, 13 mol % $Al_2O_3$, 14 mol % $Na_2O$, and 2 mol % MgO and disposing an anti-reflective coating having thirteen (13) layers on the glass substrate as shown in Table 2 below. The anti-reflective coating (e.g., as consistent with the anti-reflective coatings outlined in the disclosure) of each of the as-fabricated samples in this Example was deposited using a reactive sputtering process.

TABLE 2

| Anti-reflective coating attributes for Example 2 | | | |
|---|---|---|---|
| | Material | Refractive Index | Ex. 2 Thickness (nm) |
| Layer | | | |
| | Air | 1.0 | |
| 1 | $SiO_2$ | 1.48 | 90.3 |
| 2 | $Si_xN_y$ | 2.05 | 154.6 |
| 3 | $SiO_2$ | 1.48 | 19.8 |
| 4 | $Si_xN_y$ | 2.05 | 53 |
| 5 | $SiO_2$ | 1.48 | 12.3 |
| 6 | $Si_xN_y$ | 2.05 | 500 |
| 7 | $SiO_2$ | 1.48 | 11.6 |
| 8 | $Si_xN_y$ | 2.05 | 42.6 |
| 9 | $SiO_2$ | 1.48 | 37.5 |
| 10 | $Si_xN_y$ | 2.05 | 22.9 |
| 11 | $SiO_2$ | 1.48 | 62.3 |
| 12 | $Si_xN_y$ | 2.05 | 8.4 |
| 13 | $SiO_2$ | 1.48 | 25 |
| | Glass substrate | 1.51 | |
| Total thickness | | | 1040.3 |
| Reflected color | Y | | 0.75 |
| | L* | | |
| | a* | | −1.14 |
| | b* | | −0.98 |
| Hardness (GPa) | @ 100 nm depth | 10 | |
| | @ 500 nm depth | | |
| Max hardness (from 100 nm to 500 nm depth) | Hmax (GPa) | 14 | |
| | Depth (nm) | 450 | |
| Film stress | (MPa) | | |
| Surface roughness, $R_a$ | (nm) | | |

Example 3

The as-fabricated samples of Example 3 ("Ex. 3") were formed by providing a glass substrate having a nominal composition of 69 mol % $SiO_2$, 10 mol % $Al_2O_3$, 15 mol % $Na_2O$, and 5 mol % MgO and disposing an anti-reflective coating having five (5) layers on the glass substrate as shown in Table 3 below. The anti-reflective coating (e.g., as consistent with the anti-reflective coatings outlined in the disclosure) of each of the as-fabricated samples in this Example was deposited using a reactive sputtering process.

The modeled samples of Example 3 ("Ex. 3-M") were assumed to employ a glass substrate having the same composition of the glass substrate employed in the as-fabricated samples of this example. Further, the anti-reflective coating of each of the modeled samples was assumed to have the layer materials and physical thickness as shown in Table 3 below.

TABLE 3

| Anti-reflective coating attributes for Example 3 | | | | |
|---|---|---|---|---|
| | Material | Refractive Index | Ex. 3-M Thickness (nm) | Ex. 3 Thickness (nm) |
| Layer | | | | |
| | Air | 1.0 | | |
| 1 | $SiO_2$ | 1.48 | 81.7 | 81.1 |
| 2 | $Si_xN_y$ | 2.05 | 119.0 | 117.8 |
| 3 | $SiO_2$ | 1.48 | 33.3 | 32.7 |
| 4 | $Si_xN_y$ | 2.05 | 14.2 | 14.4 |
| 5 | $SiO_2$ | 1.48 | 25.0 | 25.0 |
| | Glass substrate | 1.51 | | |
| Total thickness | | | 273.2 | 271.0 |
| Reflected color | Y | | 0.56 | 0.47 |
| | L* | | 5.1 | 6.4 |
| | a* | | −1.5 | −0.3 |
| | b* | | −3.4 | −3.7 |
| Hardness (GPa) | @ 100 nm depth | | | 11.1 |
| | @ 500 nm depth | | | 8.9 |
| Max hardness (from 100 nm to 500 nm depth) | Hmax (GPa) | | | 11.8 |
| | Depth (nm) | | | 135.0 |
| Film stress | (MPa) | | | −521 |
| Surface roughness, $R_a$ | (nm) | | | 0.91 |

Example 4

The as-fabricated samples of Example 4 ("Ex. 4") were formed by providing a glass substrate having a nominal composition of 69 mol % $SiO_2$, 10 mol % $Al_2O_3$, 15 mol % $Na_2O$, and 5 mol % MgO and disposing an anti-reflective coating having seven (7) layers on the glass substrate, as shown in FIG. 2A and Table 4 below. The anti-reflective coating (e.g., as consistent with the anti-reflective coatings 120 outlined in the disclosure) of each of the as-fabricated samples in this Example was deposited using a reactive sputtering process.

The modeled samples of Example 4 ("Ex. 4-M") were assumed to employ a glass substrate having the same composition of the glass substrate employed in the as-fabricated samples of this example. Further, the anti-reflective coating of each of the modeled samples was assumed to have the layer materials and physical thickness as shown in Table 4 below.

TABLE 4

Anti-reflective coating attributes for Example 4

| Layer | Material | Refractive Index | Ex. 4-M Thickness (nm) | Ex. 4 Thickness (nm) |
|---|---|---|---|---|
| | Air | 1.0 | | |
| 1 | $SiO_2$ | 1.48 | 87.0 | 89.5 |
| 2 | $Si_xN_y$ | 2.05 | 135.1 | 136.1 |
| 3 | $SiO_2$ | 1.48 | 9.3 | 9.2 |
| 4 | $Si_xN_y$ | 2.05 | 135.7 | 138.3 |
| 5 | $SiO_2$ | 1.48 | 28.0 | 28.1 |
| 6 | $Si_xN_y$ | 2.05 | 19.7 | 19.9 |
| 7 | $SiO_2$ | 1.48 | 25.0 | 25.0 |
| | Glass substrate | 1.51 | | |
| Total thickness | | | 439.7 | 446.1 |
| Reflected color | Y | | 0.41 | 0.39 |
| | L* | | 3.7 | 6.5 |
| | a* | | −0.8 | −3.0 |
| | b* | | −4.0 | −5.1 |
| Hardness (GPa) | @ 100 nm depth | | | 11.3 |
| | @ 500 nm depth | | | 10.3 |
| Max hardness (from 100 nm to 500 nm depth) | Hmax (GPa) | | | 13.5 |
| | Depth (nm) | | | 172.0 |
| Film stress | (MPa) | | | −724 |
| Surface roughness, $R_a$ | (nm) | | | 1.00 |

The cover substrate 812 may be any of the Examples 1-4 described above, or may be other examples that achieve similar attributes in terms of low reflectance and high hardness. Further, the benefits observed with regard to Display 2 in comparison to Display 1 shown in FIGS. 2, 6A, 6B and 7 (see earlier) would also be evident if Display 2 was fabricated with any of the low-reflectance AR coatings of Examples 1-4. Low reflectance may be a first-surface photopic average light reflectance of 1% or less, for example, 0.9% or less, 0.8% or less, 0.7% or less, 0.6% or less, 0.5% or less, 0.4% or less, 0.3% or less, 0.25% or less, or 0.2% or less, over the optical wavelength regime. For example, Examples 1-4 exhibit average photopic reflectance values of 0.7%, 0.75%, 0.47%, and 0.39%, respectively. Alternatively, or in addition, low reflectance may be a total photopic average light reflectance of 4% or less, for example, 3.5% or less, 3.0% or less, 2.5% or less, or 2% or less, over the optical wavelength regime. High hardness may include a maximum hardness of 10 GPa or more, for example 11 GPa or more, or 12 GPa or more, or 13 GPa or more, or 14 GPa or more, or 15 GPa or more, or 16 GPa or more, or 17 GPa or more, or 18 GPa or more, or 19 GPa or more, or 20 GPa or more, and in some embodiments up to 50 GPa.

In some embodiments, the article having the anti-reflective coating exhibits a first-surface photopic average light reflectance of 1% or less, for example, 0.9% or less, 0.8% or less, 0.7% or less, 0.6% or less, 0.5% or less, 0.4% or less, 0.3% or less, 0.25% or less, or 0.2% or less, over the optical wavelength regime (as used herein, the "optical wavelength regime" includes the wavelength range from about 380 nm to about 720 nm, for example from about 400 nm to about 800 nm—and more specifically from about 450 nm to about 650 nm—when measured at the anti-reflective surface (e.g., first-surface reflectance as when removing the reflections from an uncoated back surface of the article, for example through using index-matching oils on the back surface coupled to an absorber, or other known methods). Unless otherwise specified, the average reflectance is measured at normal incident illumination angle of 0 degrees (however, such measurements may be provided at near-normal incident illumination angles, i.e., up to 10 degrees from normal).

As used herein, "photopic average reflectance" mimics the response of the human eye by weighting the reflectance versus wavelength spectrum according to the human eye's sensitivity. Photopic average reflectance may also be defined as the luminance, or tristimulus Y value of reflected light, according to known conventions for example CIE color space conventions. The photopic average reflectance is defined in Equation (4) as the spectral reflectance, R(λ) multiplied by the illuminant spectrum, I(λ) and the CIE's color matching function $\bar{y}(\lambda)$, related to the eye's spectral response:

$$\langle R_p \rangle = \int_{330\ mm}^{720\ mm} R(\lambda) \times I(\lambda) \times \bar{y}(\lambda) d\lambda \quad (4)$$

In some embodiments, the article having the anti-reflective coating exhibits a total photopic average light reflectance of 4% or less, for example, 3.5% or less, 3.0% or less, 2.5% or less, or 2% or less, over the optical wavelength regime.

In some embodiments, the article having the anti-reflective coating exhibits a maximum hardness of 10 GPa or more, for example 11 GPa or more, or 12 GPa or more, or 13 GPa or more, or 14 GPa or more, or 15 GPa or more, or 16 GPa or more, or 17 GPa or more, or 18 GPa or more, or 19 GPa or more, or 20 GPa or more, and in some embodiments up to 50 GPa.

As used herein, maximum hardness is measured by a Berkovich Indenter Hardness Test. As used herein, the "Berkovich Indenter Hardness Test" includes measuring the hardness of a material on a surface thereof by indenting the surface with a diamond Berkovich indenter. The Berkovich Indenter Hardness Test includes indenting the anti-reflective surface of the article or the surface of the anti-reflective coating with the diamond Berkovich indenter to form an indent to an indentation depth in the range from about 50 nm to about 1000 nm (or the entire thickness of the anti-reflective coating or layer, whichever is less) and measuring the hardness from this indentation at various points along the entire indentation depth range, along a specified segment of this indentation depth (e.g., in the depth range from about 100 nm to about 500 nm), or at a particular indentation depth (e.g., at a depth of 100 nm, at a depth of 500 nm, etc.) generally using the methods set forth in Oliver, W. C.; Pharr, G. M. An improved technique for determining hardness and elastic modulus using load and displacement sensing indentation experiments. *See J. Mater. Res.*, Vol. 7, No. 6, 1992, 1564-1583; and Oliver, W. C. and Pharr, G. M, "Measurement of Hardness and Elastic Modulus by Instrument Indentation: Advances in Understanding and Refinements to Methodology", *J. Mater. Res.*, Vol. 19, No. 1, 2004, 3-20. Further, when hardness is measured over an indentation depth range (e.g., in the depth range from about 100 nm to about 500 nm), the results can be reported as a maximum hardness within the specified range, wherein the maximum is selected from the measurements taken at each depth within that range. As used herein, "hardness" and "maximum hardness" both refer to as-measured hardness values, not averages of hardness values. Similarly, when hardness is measured at an indentation depth, the value of the hardness obtained from the Berkovich Indenter Hardness Test is given for that particular indentation depth.

Typically, in nanoindentation measurement methods (such as by using a Berkovich indenter) of a coating that is harder than the underlying substrate, the measured hardness may appear to increase initially due to development of the plastic zone at shallow indentation depths and then increases and reaches a maximum value or plateau at deeper indentation depths. Thereafter, hardness begins to decrease at even deeper indentation depths due to the effect of the underlying substrate. Where a substrate having an increased hardness compared to the coating is utilized, the same effect can be seen; however, the hardness increases at deeper indentation depths due to the effect of the underlying substrate.

The indentation depth range and the hardness values at certain indentation depth range(s) can be selected to identify a particular hardness response of the optical film structures and layers thereof, described herein, without the effect of the underlying substrate. When measuring hardness of the optical film structure (when disposed on a substrate) with a Berkovich indenter, the region of permanent deformation (plastic zone) of a material is associated with the hardness of the material. During indentation, an elastic stress field extends well beyond this region of permanent deformation. As indentation depth increases, the apparent hardness and modulus are influenced by stress field interactions with the underlying substrate. The substrate influence on hardness occurs at deeper indentation depths (for example, typically at depths greater than about 10% of the optical film structure or layer thickness). Moreover, a further complication is that the hardness response utilizes a certain minimum load to develop full plasticity during the indentation process. Prior to that certain minimum load, the hardness shows a generally increasing trend.

At small indentation depths (which also may be characterized as small loads) (e.g., up to about 50 nm), the apparent hardness of a material appears to increase dramatically versus indentation depth. This small indentation depth regime does not represent a true metric of hardness but instead, reflects the development of the aforementioned plastic zone, which is related to the finite radius of curvature of the indenter. At intermediate indentation depths, the apparent hardness approaches maximum levels. At deeper indentation depths, the influence of the substrate becomes more pronounced as the indentation depths increase. Hardness may begin to drop dramatically once the indentation depth exceeds about 30% of the optical film structure thickness or the layer thickness.

As noted above, those with ordinary skill in the art can consider various test-related considerations (including indentation depth) in ensuring that the hardness and maximum hardness values of the coating and/or article obtained from the Berkovich Indenter Hardness Test are indicative of these elements, rather than being unduly influenced by the substrate, for example.

Embodiments and the functional operations described herein can be implemented in digital electronic circuitry, or in computer software, firmware, or hardware, including the structures disclosed in this specification and their structural equivalents, or in combinations of one or more of them. Embodiments described herein can be implemented as one or more computer program products, for example, one or more modules of computer program instructions encoded on a tangible program carrier for execution by, or to control the operation of, data processing apparatus. The tangible program carrier can be a computer readable medium. The computer readable medium can be a machine-readable storage device, a machine readable storage substrate, a memory device, or a combination of one or more of them.

The term "processor" or "controller" can encompass all apparatus, devices, and machines for processing data, including by way of example a programmable processor, a computer, or multiple processors or computers. The processor can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, or declarative or procedural languages, and it can be deployed in any form, including as a standalone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes described herein can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit) to name a few.

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more data memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA).

Computer readable media suitable for storing computer program instructions and data include all forms data memory including nonvolatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, embodiments described herein can be implemented on a computer having a display device, e.g., a CRT (cathode ray tube) or LCD (liquid crystal display) monitor, and the like for displaying information to the user and a keyboard and a pointing device, e.g., a mouse or a trackball, or a touch screen by which the user can provide input to the computer. Other kinds of devices can be used to provide for interaction with a user as well; for example, input from the user can be received in any form, including acoustic, speech, or tactile input.

Embodiments described herein can be implemented in a computing system that includes a back end component, e.g., as a data server, or that includes a middleware component, e.g., an application server, or that includes a front end component, e.g., a client computer having a graphical user interface or a Web browser through which a user can interact with implementations of the subject matter described herein, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

As used herein, the term "about" means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. When the term "about" is used in describing a value or an end-point of a range, the disclosure should be understood to include the specific value or end-point referred to. Whether or not a numerical value or end-point of a range in the specification recites "about," the numerical value or end-point of a range is intended to include two embodiments: one modified by "about," and one not modified by "about." It will be further understood that the endpoints of each of the ranges are significant both in relation to the other endpoint, and independently of the other endpoint.

The terms "substantial," "substantially," and variations thereof as used herein are intended to note that a described feature is equal or approximately equal to a value or description. For example, a "substantially planar" surface is intended to denote a surface that is planar or approximately planar. Moreover, "substantially" is intended to denote that two values are equal or approximately equal. In some embodiments, "substantially" may denote values within about 10% of each other, such as within about 5% of each other, or within about 2% of each other.

Directional terms as used herein—for example up, down, right, left, front, back, top, bottom, inward, outward—are made only with reference to the figures as drawn and are not intended to imply absolute orientation.

As used herein the terms "the," "a," or "an," mean "at least one," and should not be limited to "only one" unless explicitly indicated to the contrary. Thus, for example, reference to "a component" includes embodiments having two or more such components unless the context clearly indicates otherwise.

As used herein, the terms "comprising" and "including," and variations thereof, shall be construed as synonymous and open ended, unless otherwise indicated. A list of elements following the transitional phrases comprising or including is a non-exclusive list, such that elements in addition to those specifically recited in the list may also be present.

It will be apparent to those skilled in the art that various modifications and variations can be made to the present disclosure without departing from the spirit and scope of the disclosure. Thus, it is intended that the present disclosure cover such modifications and variations provided they come within the scope of the appended claims and their equivalents.

What is claimed is:

1. A display device, having reduced energy consumption, comprising:

a housing comprising a front surface, a back surface and side surfaces; and electrical components at least partially within the housing, the electrical components comprising a controller, a memory, and a display, the display at or adjacent the front surface of the housing;

the controller being programmed to:

a. determine lighting conditions ambient to the display device, b. determine content that a user chooses to view on the display device, c. calculate the user's perception of display quality using an image appearance model, and d. adjust, when the perceived display quality is higher than a target display quality, display device conditions so that the perceived display quality matches the target display quality so as to reduce energy consumption, wherein the image appearance model is a function of a reflectance of the display device, the ambient lighting conditions, and the content.

2. The display device of claim 1, wherein the ambient lighting conditions comprise illuminance.

3. The display device of claim 1, wherein the ambient lighting conditions comprise color.

4. The display device of claim 1, wherein the ambient lighting conditions are actively sensed by the display device.

5. The display device of claim 1, wherein the content comprises one or more of video, movie, pictures, graphics, text, email.

6. The display device of claim 1, wherein the target display quality is determined using the image appearance model.

7. The display device of claim 1, wherein the image appearance model approximates the user's perceived brightness, contrast, or color saturation of the content.

8. The display device of claim 1, wherein the display device comprises a cover substrate, the cover substrate comprising an anti-reflection coating.

9. The display device of claim 1, wherein the display device operating conditions comprise luminance output.

10. The display device of claim 1, wherein the display device operating conditions comprise color gamut.

11. The display device of claim 1, wherein adjusting the display device operating conditions is a function of display device reflectance.

12. The display device of claim 11, wherein the display device reflectance is actively sensed by the display device.

13. The display device of claim 1, wherein the display device comprises a total reflectance of 3% or less.

14. The display device of claim 8, wherein the cover substrate comprises a first-surface photopic average reflectance of 1% or less over an optical wavelength regime from about 380 nm to about 720 nm.

15. The display device of claim 8, wherein the cover substrate comprises a surface having a maximum hardness of 10 GPa or more over indentation depths from 100-500 nm.

16. The display device of claim 1, wherein the display device further comprises a contrast ratio (CR) of at least 5 at a display luminance of 200 cd/m$^2$ under an ambient lighting illuminance of 1,000 lux.

17. The display device of claim 1, wherein the display device further comprises a calculated perceived contrast length (PCL) of at least 20 at a display luminance of 200 cd/m$^2$ under an ambient light illuminance of 1,000 lux.

18. A display device, having reduced energy consumption, comprising:

a housing comprising a front surface, a back surface and side surfaces; and electrical components at least partially within the housing, the electrical components comprising a controller, a memory, and a display, the display at or adjacent the front surface of the housing;

the controller being programmed to (i) determine that an ambient light illuminance value is 1000 lux to 10,000 lux, and (ii) as a consequence, cause the display luminance to be 220 cd/m$^2$ to 280 cd/m$^2$.

19. The display device of claim 18, wherein the display device further comprises a calculated perceived contrast length (PCL) of at least 20 when the controller determines that the ambient light illuminance is 1,000 lux.

* * * * *